US005657769A

United States Patent [19]

Stiller

[11] Patent Number: 5,657,769

[45] Date of Patent: Aug. 19, 1997

[54] INCLINED CIGAR ASHTRAY REST

[76] Inventor: Michael Stiller, 2347 Purdue Dr., Costa Mesa, Calif. 92626

[21] Appl. No.: 634,742

[22] Filed: Apr. 19, 1996

[51] Int. Cl.[6] ..... A24F 19/00

[52] U.S. Cl. ..... 131/241; 131/240.1

[58] Field of Search ..... D27/702, 138; 131/231, 240.1, 241

[56] References Cited

U.S. PATENT DOCUMENTS

| | | | |
|---|---|---|---|
| D. 122,585 | 9/1940 | Frank | 131/240.1 X |
| D. 123,318 | 10/1940 | Wright . | |
| D. 129,426 | 9/1941 | Jindrak . | |
| D. 155,083 | 10/1949 | Frank | 131/240.1 X |
| D. 169,223 | 3/1953 | Revell . | |
| D. 175,648 | 9/1955 | Ross et al. . | |
| D. 191,254 | 8/1961 | Barron et al. . | |
| 785,377 | 3/1905 | Poppert . | |
| 1,294,815 | 2/1919 | McCully . | |
| 1,312,530 | 8/1919 | Fuller . | |
| 1,667,663 | 4/1928 | Hoos . | |
| 1,953,755 | 4/1934 | Gorman | 131/240.1 |
| 2,063,717 | 12/1936 | Barbiere . | |
| 2,092,743 | 9/1937 | Hirner . | |
| 2,111,172 | 3/1938 | Cook . | |
| 2,404,174 | 7/1946 | Hines . | |
| 3,620,225 | 11/1971 | Balley . | |
| 3,675,662 | 7/1972 | Askins . | |
| 3,683,938 | 8/1972 | Rowland . | |
| 3,750,824 | 8/1973 | Walton | 131/242 X |
| 4,634,014 | 1/1987 | Carr . | |
| 4,920,988 | 5/1990 | Cancellara | 131/240.1 X |
| 4,982,746 | 1/1991 | Pruyne . | |
| 5,105,832 | 4/1992 | Tassé . | |
| 5,287,862 | 2/1994 | Pruyne | 131/240.1 |

*Primary Examiner*—Jennifer Bahr
*Attorney, Agent, or Firm*—Donald E. Stout

[57] ABSTRACT

An inclined ashtray rest provides only a slight inclination to the cigar or cigarette being held. Since only a slight inclination is used by the cigar and cigarette ashtray rest, the cigar or cigarette does not need to be significantly inclined above the support surface. Consequently, the inclined ashtray rests may be integrally formed of a single material, such as glass or ceramic. The integrally formed inclined ashtray rest can further be configured with a number of open channels to accommodate a corresponding number of cigars or cigarettes, and these open channels may be integrally formed with the inclined ashtray rest. Additionally, a common ash receiving area may be formed for servicing all of the open channels. The slight inclination of each of the open channels is optimal for keeping the tip of the cigar cooler, by accelerating heat dissipation through the burning end. This is particularly advantageous in the case of cigars, where if the tip gets too hot, the smoking experience becomes less enjoyable.

20 Claims, 1 Drawing Sheet

INCLINED CIGAR ASHTRAY REST

BACKGROUND OF THE INVENTION

1. Field of the Invention

The present invention relates to ashtrays and, more particularly, to ashtrays having rests for supporting cigars.

2. Description of Related Art

Ashtrays have been used in the prior art to provide receptacles for ashes from cigars and cigarettes as they burn and for disposal of the cigar or cigarette after smoking of the cigar or cigarette has been completed. Ashtrays usually are designed for providing a rest for the cigar or cigarette, in order to hold the cigar or cigarette as it burns, when not being smoked, but when the smoker desires to keep it lit and available for smoking.

The angle of inclination Used for holding the cigar or cigarette has varied among prior art ashtrays between steep declines, slight declines, and relatively steep inclines. Traditional designs for ashtrays, for example, provide a dish having one or more notches or smooth arcuate recesses in the periphery of the dish, in which the cigar or cigarette can be rested. The cigar or cigarette is often rested in the traditional ashtray design in a steep decline state, where the proximal end of the cigar or cigarette is elevated above the burning end of the cigar or cigarette.

Other conventional ashtrays, such as that disclosed in U.S. Pat. No. 5,287,862 issued to Pruyne, incorporate only slight decline angles for holding the cigar or cigarette. According to the Pruyne patent, a slight decline orientation of the cigar or cigarette facilitates the flow of tar released in the cigarette, for example, to move downwardly to the burning end of the cigarette rather than flowing to the paper on the side of the cigarette and condensing thereon to discolor the cigarette and adversely affect the taste as the cigarette is later smoked. A perceived advantage of conventional ashtrays, which are configured to hold a cigar or cigarette in a slightly declined orientation, is to ensure that the cigarette falls into the ashtray as it burns down unattended, thereby avoiding a potential fire.

One prior art ash receptacle orientates the cigar or cigarette in an upward orientation, such that the burning tip is elevated above the proximal end of the cigar or cigarette. U.S. Pat. No. 1,294,815 to McCully discloses a combined cigar and cigarette holder, which has semi-circular rests 8 and 9 for accommodating cigars and cigarettes, respectively, and which also has a vertical post 6 for elevating the cigar and cigarette holder significantly above a support surface. The cigar and cigarette holder holds the cigar or cigarette at a relatively steep inclined angle, and therefore requires the vertical post 6 to elevate the cigar or cigarette above the support surface, in order to prevent the proximal end of the cigar or cigarette from touching the support surface. Because of this steep incline orientation, the vertical post 6 is further needed to hold the cigar or cigarette significantly above the support surface to provide for easier gripping of the proximal end of the cigar or cigarette.

Additionally, the semi-circular rests 8 and 9 are designed to closely grip and hold the cigar and cigarette, respectively, to thereby prevent slippage of the cigar and cigarette onto a countertop or flammable surface, because of the relatively steep incline angle. Since these rests 8 and 9 are adapted to tightly grip and cradle the cigar and cigarette, respectively, each rest 8, 9 can only accommodate a specific diameter cigar or cigarette. The tight gripping and holding of the cigar or cigarette at rests 8, 9, respectively, further makes placement of the cigar or cigarette, and removal thereof, difficult and inconvenient for the user.

SUMMARY OF THE INVENTION

The inclined ashtray rest of the present invention is particularly suited to cigars, and provides only a slight inclination of the burning distal end relative to the proximal end. Since only a slight inclination is used by the ashtray rest of the present invention, the cigar does not need to be significantly inclined above the support surface. Consequently, the inclined ashtray rests may be integrally formed of a single material, such as glass or ceramic. The integrally formed inclined ashtray rest can further be configured with a number of open channels to accommodate a corresponding number of cigars or cigarettes, and these open channels may be integrally formed with the inclined ashtray rest. Additionally, with the integrally formed inclined ashtray rest of the present invention, a common ash receiving area may be formed for servicing all of the open channels. A particular advantage of the present invention is that the slight inclination of each of the open channels has been found by the inventor to be optimal for keeping the tip of a cigar cooler, by accelerating heat dissipation through the burning end. This is particularly advantageous in the case of cigars, where if the tip gets too hot, the smoking experience becomes less enjoyable.

The open channels are integrally formed into the base portion of the inclined ashtray rests, and are shallow enough to facilitate the holding of a large variety of cigars having different diameters. Additionally, the shallow open channels of the present invention facilitate easy and convenient insertion and removal of a cigar. The slight inclination angle is also sufficiently shallow to avoid safety problems caused by slippage of the cigar down onto a table or other flammable surface.

The present invention, together with additional features and advantages thereof, may best be understood by reference to the following description taken in connection with the accompanying illustrative drawings.

DETAILED DESCRIPTION OF THE PRESENTLY PREFERRED EMBODIMENT

Figure 1:
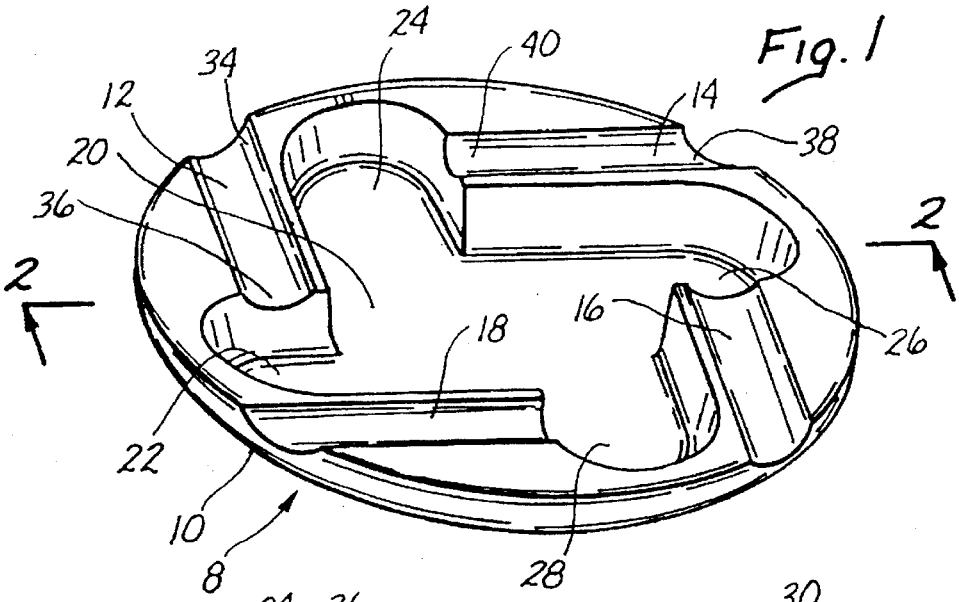
FIG. 1 is a perspective view of the inclined ashtray rest of the presently preferred embodiment.

The inclined ashtray rest 8 of the presently preferred embodiment is illustrated in FIG. 1, having a base portion 10 and a plurality of open channels 12, 14, 16, and 18 integrally formed in the base portion 10. The base portion 10 further comprises an ash receiving recess 20 integrally formed within the base portion 10. The base portion 10 preferably comprises either a glass or a ceramic, or both, but may be formed of other materials, as well. The ash receiving recess 20 comprises a plurality of sub-chambers 22, 24, 26, and 28. Each of the sub-chambers 22, 24, 26, and 28 accepts ashes from cigars placed within the open channels 12, 14, 16, and 18, respectively.

Figure 2:
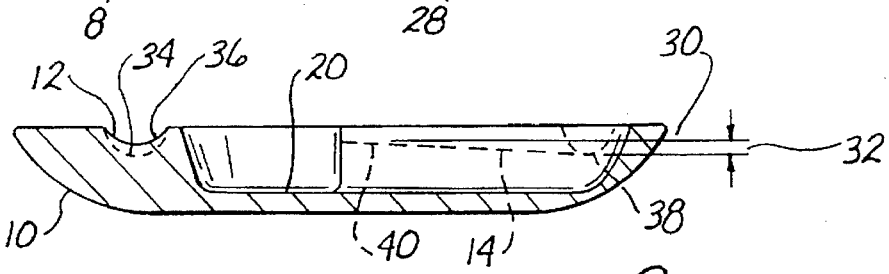
FIG. 2 is a cross-sectional view of the inclined ashtray rest of the presently preferred embodiment.
Figure 3:
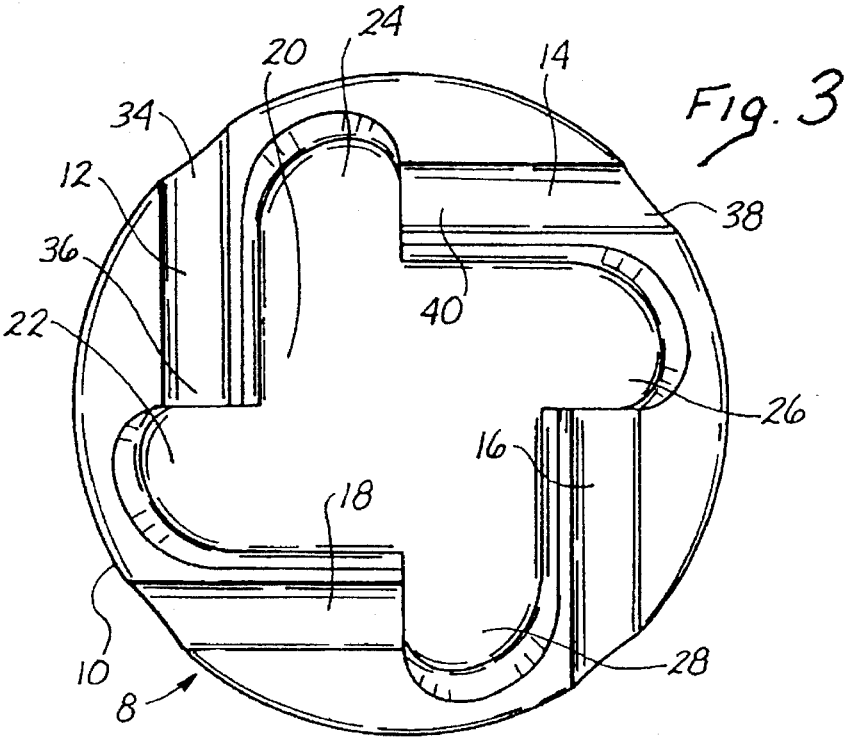
FIG. 3 is a top planar view of the inclined ashtray rest of the presently preferred embodiment.

A cross-sectional view of the inclined cigar and cigarette ashtray rest 8, taken along the line 2, 2 of FIG. 1, is illustrated in FIG. 2. Each of the open channels 12, 14, 16, and 18 is configured with a slight inclination to thereby hold a cigar in a slightly inclined state. Put another way, each of the open channels 12, 14, 16, and 18 is slightly inclined in a radially inwardly direction. As shown in FIG. 2, the open channel 14, having a proximal end 38 and a distal end 40, forms an angle with a line 30 that is parallel to the bottom planar surface of the base portion 10. The angle 32 between the bottom surface of the open channel 14 and the horizontal line 30 is preferably between one and seven degrees. In the presently preferred embodiment, an angle of three degrees has been unexpectedly found to be best suited for facilitating cooler burning of the tip of the cigar, which dramatically improves the flavor to the smoker. The open channel 12 shown in FIG. 2 also comprises a proximal end 34 and a distal end 36. As with the open channel 14, a cigar can be placed within the channel, such that the burning end of the cigar is near the distal end of the open channel and, preferably, extends over a corresponding sub-chamber. For example, a cigar placed within the open channel 12 should preferably have a burning tip extending over the sub-chamber 22. As shown in the cross-sectional view of FIG. 2, the distal end 36 of the open channel 12 is elevated above the proximal end 34 of the open channel 12. The cross-sectional view of the open channel 12 shown in FIG. 2 further illustrates the shallow depth and angle of the open channel 12. This shallow depth of the open channel 12 facilitates the holding of variously sized cigars, and is also suitable for holding cigarettes if desired. FIG. 3 illustrates a top planar view of the inclined ashtray rest of the present invention. As shown in FIG. 3, each of the open channels 12, 14, 16, and 18 is oriented in a somewhat rectangular fashion. The open channels 12 and 16 are parallel to one another, and the open channels 14 and 18 are parallel to one another. Additionally, the open channels 12 and 16 are perpendicular to the open channels 14 and 18.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

I claim:

1. An inclined ashtray rest, comprising:

a base portion having an interior and an outer edge; and at least one open channel formed in the base portion, the open channel having an open side, a lowered end near the outer edge, a raised end near the interior, and a predetermined length extending between the lowered end and the outer edge, the at least one open channel having a length adapted for receiving at least a portion of a burning cigar or cigarette therein to thereby support the cigar or cigarette, the at least one open channel being dimensioned to receive and loosely cradle the portion of the burning cigar or cigarette, so that with the base portion resting on a flat surface and a cigar or cigarette having a length which is greater than the predetermined length resting in the at least one open channel with a burning end of the cigar or cigarette positioned near the interior, the cigar or cigarette will be inclined with a burning end of the cigar or cigarette elevated above a proximal end of the cigar or cigarette and the proximal end will extend beyond the outer edge of the base portion to facilitate easy gripping thereof by a user.

2. The inclined ashtray rest as recited in claim 1, further comprising an ash-receiving recess formed in the base portion.

3. The inclined ashtray rest as recited in claim 2, wherein the ash-receiving recess is disposed in the base portion beneath each of the open channels, so that the at least one, open channel is elevated above the ash receiving recess.

4. The inclined ashtray rest as recited in claim 1, wherein the at least one open channel extends circumferentially around and contacts less than half of a circumference of the cigar or cigarette, to thereby facilitate holding of cigars and cigarettes with different diameters.

5. The inclined ashtray rest as recited in claim 1, wherein the at least one open channel comprises four open channels.

6. The inclined ashtray rest as recited in claim 5, wherein the lengths of at least two of the four open channels are perpendicular to each other.

7. An inclined ashtray rest comprising: a base portion having an interior surrounded by an outer edge; and a plurality of open channels formed in the base portion, each open channel having an open side, a lowered end near the outer edge, and a raised end near the interior, each open channel being adapted for receiving at least a portion of a burning cigar or cigarette therein, each open channel being adapted to support the cigar or cigarette and having an upward inclination angle of between approximately one and approximately seven degrees, relative to a horizontal surface, so that when the base portion is resting on the horizontal surface the raised end is elevated above the lowered end and a burning end of a cigar or cigarette placed near the raised end will be elevated with respect to a proximal end of the cigar or cigarette, the upward inclination angle being large enough to direct smoke from the burning end away from the proximal end and being small enough to deter self-extinguishing of the cigar or cigarette and to deter sliding of the cigar or cigarette in a proximal direction out of the open channel.

8. The inclined ashtray rest as recited in claim 7, wherein each open channel is adapted for supporting the cigar or cigarette at an upward inclination angle of approximately three degrees.

9. The inclined ashtray rest as recited in claim 7, wherein the base portion comprises an integrally-formed unit.

10. The inclined ashtray rest as recited in claim 9, wherein the base portion comprises at least one of glass and ceramic.

11. The inclined ashtray rest as recited in claim 7, further comprising an ash-receiving recess formed in the base portion.

12. The inclined ashtray rest as recited in claim 11, wherein the ash-receiving recess is disposed in the base portion beneath each of the open channels.

13. The inclined ashtray rest-as recited in claim 12, wherein the ash-receiving recess comprises a plurality of sub-chambers formed in the base portion, each one of the plurality of sub-chambers corresponding to one of the plurality of open channels.

14. The inclined ashtray rest as recited in claim 13, wherein each one of the sub-chambers is adapted for receiving ashes from a cigar or cigarette in a corresponding one of the plurality of open channels.

15. An inclined ashtray rest, comprising:

a base portion having an interior and an outer edge; and a plurality of open channels formed in the base portion, each open channel having a predetermined length, an open side, and being adapted for receiving at least a portion of a burning cigar or cigarette therein, each open channel being adapted to support the cigar or cigarette at an upward inclination, so that when the base portion is resting on a horizontal surface and a cigar or cigarette having a length which is greater than the predetermined length is resting in the open channel with a burning end of the cigar or cigarette positioned near the interior, the burning end of the cigar or cigarette is elevated with respect to a proximal end of the cigar or cigarette and the proximal end extends beyond the outer edge of the base portion to facilitate easy gripping thereof by a user.

16. The inclined ashtray rest as recited in claim 15, wherein each open channel is adapted for supporting the cigar or cigarette at an upward inclination angle of between approximately one and approximately seven degrees.

17. The inclined ashtray rest as recited in claim 15, wherein each open channel is adapted for supporting the cigar or cigarette at an upward inclination angle of approximately three degrees.

18. The inclined ashtray rest as recited in claim 15, each open channel being dimensioned to receive and loosely cradle the portion of the burning cigar or cigarette received therein.

19. The inclined ashtray rest as recited in claim 18, wherein each open channel is adapted for supporting the cigar or cigarette at an upward inclination angle of between approximately one and approximately seven degrees.

20. An inclined ashtray rest, comprising:

a base portion;

an ash-receiving recess formed in the base portion; and at least one open channel formed in the base portion, the open channel having an open side and a length adapted for receiving at least a portion of a burning cigar or cigarette therein to thereby support the cigar or cigarette, the open channel being dimensioned to receive and loosely cradle the cigar or cigarette and having an upward inclination angle increasing in elevation in a direction toward the ash-receiving recess of between approximately one and approximately seven degrees, relative to a flat surface, so that when the base portion is resting on the flat surface a burning end of a cigar or cigarette will be held near the ash-receiving recess and elevated with respect to a proximal end of the cigar or cigarette, the upward inclination angle being large enough to direct smoke from the burning end away from the proximal end and being small enough to deter self-extinguishing of the cigar or cigarette and to deter sliding of the cigar or cigarette in a proximal direction out of the open channel.

* * * * *